US011786064B2

(12) United States Patent
Wang

(10) Patent No.: US 11,786,064 B2
(45) Date of Patent: Oct. 17, 2023

(54) ZEBRA CURTAIN

(71) Applicant: SHENZHEN RUIQING XINGYE PLASTIC CO. LTD., Guangdong (CN)

(72) Inventor: Chih-Yung Wang, Taipei (TW)

(73) Assignee: SHENZHEN RUIQING XINGYE PLASTIC CO. LTD., Guangdong (CN)

( * ) Notice: Subject to any disclaimer, the term of this patent is extended or adjusted under 35 U.S.C. 154(b) by 0 days.

(21) Appl. No.: 17/211,124

(22) Filed: Mar. 24, 2021

(65) Prior Publication Data

US 2022/0304493 A1 Sep. 29, 2022

(51) Int. Cl.
*A47H 1/104* (2006.01)
*A47H 1/06* (2006.01)

(52) U.S. Cl.
CPC ..... *A47H 1/104* (2013.01); *A47H 1/06* (2013.01)

(58) Field of Classification Search
CPC ..... E06B 2009/2405; E06B 2009/2447; E06B 2009/2458; E06B 2009/405; E06B 2009/407; E06B 9/40; A47H 1/104; A47H 1/06
See application file for complete search history.

(56) References Cited

U.S. PATENT DOCUMENTS 256,557 A * 4/1882 Farley ..... E06B 9/40 160/241
1,042,491 A * 10/1912 Smith ..... E06B 9/40 160/395
4,373,569 A * 2/1983 Barettella ..... E06B 9/50 160/323.1
5,676,415 A * 10/1997 Ament ..... B60R 5/047 296/37.16
5,881,793 A * 3/1999 Righter ..... B60R 5/047 296/37.16
7,549,615 B2 * 6/2009 Shevick ..... E06B 9/323 248/200.1

(Continued)

FOREIGN PATENT DOCUMENTS

DE 202004016347 U1 * 3/2005 ..... E06B 9/42
DE 202006000857 U1 * 5/2006 ..... E06B 9/42

*Primary Examiner* — Daniel P Cahn
*Assistant Examiner* — Matthew R. Shepherd
(74) *Attorney, Agent, or Firm* — Muncy, Geissler, Olds & Lowe, P.C.

(57) ABSTRACT

A zebra curtain comprises a curtain rolling device, an upper rail, two fixing brackets, a lower rail and a curtain sheet. Two ends of the curtain sheet are respectively fixed on the upper rail and the curtain rolling device. The upper rail comprises a first shaft sleeve and a second shaft sleeve. The first shaft sleeve comprises a first protruding shaft, and the second shaft sleeve comprises a bearing, a second protruding shaft, a spring and a positioning piece. The curtain sheet comprises light-transmitting parts and light-impermeable portions arranged at intervals. The second protruding shaft moves inside the bearing by the spring pressing to be separated from the fixing bracket and to take off the zebra curtain, then adjusting the light-transmitting parts and the light-impermeable parts, and releasing the second protruding shaft to be axially connected with the fixing bracket, thereby completing the assembly of the zebra curtain.

3 Claims, 13 Drawing Sheets

(56) References Cited

U.S. PATENT DOCUMENTS

| | | | | |
|---|---|---|---|---|
| 7,665,505 | B2 * | 2/2010 | McCormick | E06B 9/44 160/291 |
| 9,926,740 | B2 * | 3/2018 | Pham | E06B 9/42 |
| 10,588,442 | B2 * | 3/2020 | Ng | E06B 9/50 |
| 2006/0021715 | A1 * | 2/2006 | Nien | E06B 9/50 160/121.1 |
| 2007/0107857 | A1 * | 5/2007 | Wang | E06B 9/42 160/321 |
| 2008/0142171 | A1 * | 6/2008 | Koop | E06B 9/50 160/243 |
| 2009/0014134 | A1 * | 1/2009 | Hanley | E06B 9/42 160/266 |
| 2009/0173454 | A1 * | 7/2009 | Cheng | E06B 9/40 160/319 |
| 2010/0200179 | A1 * | 8/2010 | Di Stefano | E06B 9/42 160/368.1 |
| 2014/0190642 | A1 * | 7/2014 | Chou | E06B 9/50 160/323.1 |
| 2016/0298388 | A1 * | 10/2016 | Tao | E06B 9/44 |
| 2018/0283096 | A1 * | 10/2018 | Nelson | E06B 9/72 |
| 2018/0291682 | A1 * | 10/2018 | Walter-Seifart | E06B 9/68 |
| 2018/0340369 | A1 * | 11/2018 | Goldberg | E06B 9/44 |
| 2018/0355664 | A1 * | 12/2018 | Schorling | E06B 9/42 |
| 2019/0136615 | A1 * | 5/2019 | Vangberg-Brinkmann | E06B 9/323 |
| 2019/0162022 | A1 * | 5/2019 | Geiger | E06B 9/68 |
| 2019/0316414 | A1 * | 10/2019 | Zhang | E06B 9/322 |
| 2020/0248504 | A1 * | 8/2020 | Risher | E06B 9/42 |
| 2022/0081969 | A1 * | 3/2022 | Wang | E06B 9/50 |

* cited by examiner

ZEBRA CURTAIN

FIELD OF THE INVENTION

The invention relates to a curtain, in particular to a zebra curtain which is convenient for a user to adjust positions of light-transmitting parts and light-impermeable parts arranged at intervals of curtain sheets according to requirements.

BACKGROUND OF THE INVENTION

A zebra curtain 1 with a spaced column or row used for shielding sunlight and decorating places such as houses, office doors and windows has become a quite popular phenomenon. However, as shown in FIG. 1, the zebra curtain includes a curtain sheet 11, and the curtain sheet 11 includes a light-transmitting part 12 with hollowed-out holes 121 and a light-impermeable part 13 without holes. After assembling the zebra curtain 1 with forward overlap double layers, a rear end 110 of the curtain sheet 11 is first fixed, a front end 111 of the curtain sheet 11 passes around the lower rail 14 to be wound on an outer surface of a sleeve 15, and the light-transmitting part 12 and the light-impermeable part 13 of the curtain sheet 11 are manually wound or pulled downward by a pull cord 16 such as a chain or rope. A light intensity of the indoor space can be adjusted conveniently.

If the curtain sheet 11 of the zebra curtain 1 is assembled, a user manually pull the curtain sheet 11 of the zebra curtain 1 downward by the pull cord 16, so that a bottom end of the curtain sheet 11 of the zebra curtain 1 collides against a window sill 17, and it is found that symmetrical positions of the light-transmitting part 12 and the light-impermeable part 13 of the curtain sheet 11 are not completely aligned, and the bottom end of the curtain sheet 11 is wrinkled, influencing the overall aesthetic appearance of the curtain sheet 11. The user cannot remove the curtain sheet 11 from the rear end 110 at all, and the user cannot adjust the symmetrical positions of the light-transmitting part 12 and the light-impermeable part 13 of the curtain sheet 11 as required. Therefore, it is necessary to disassemble the curtain sheet 11 again, and then reassemble the curtain sheet 11 and fix the rear end 110 of the curtain sheet 11 after the symmetrical positions of the light-transmitting part 12 and the light-impermeable part 13 are readjusted. Thus, it is troublesome and time-consuming to adjust the curtain sheet 11. Furthermore, the curtain sheet 11 of the zebra curtain 1 is manually rolled up or pulled down by the pull cord 16, which makes it easy for a child to play as a toy for playing a game, which is dangerous, even reduces the purchase intention of a consumer, makes it difficult to increase the desirability, and thus affects the practicability of the zebra curtain 1.

In addition, the safety problem of the pull cord 16 of the zebra curtain 1 in the prior art is considered, and a zebra curtain 2 is developed. As shown in FIG. 2, a main interior of the zebra curtain 2 utilizes a spring (not shown) to wind up a curtain rolling device 21, and a lower rail 22 with a counterweight body (not shown) is matched. A curtain sheet 23 can be automatically rolled or pulled by a user by applying upward or downward force to a lower rail 22, so that the curtain sheets 23 can be automatically rolled to positions as required by the user. The curtain sheets 23 do not need to be pulled up and down by a pull cord, and danger is avoided. Although the zebra curtain 2 is safe, if the curtain sheet 23 of the zebra curtain 2 are assembled, a user pulls the curtain sheet 23 of the zebra curtain 2 with downward force by the lower rail 22, so that the bottom end of the curtain sheet 23 of the zebra curtain 2 collides against a window sill 26, and it is found that symmetrical positions of a light-transmitting part 24 and a light-impermeable part 25 alternately arranged at intervals of the curtain sheet 23 are not completely aligned, and a bottom end of the curtain sheet 23 is wrinkled, so that the overall aesthetic appearance of the curtain sheet 23 is influenced. Further, the zebra curtain 2 is generally assembled by a manufacturer to be mounted at a position required by a user, the user cannot remove the zebra curtain 2 from a fixed rear end 230 of the curtain sheet 23 at all, and the user cannot adjust the symmetrical positions of the light-transmitting part 24 and the light-impermeable part 25 of the curtain sheets 23 as required. Therefore, it is necessary to disassemble the curtain sheets 23 again, reassemble the curtain sheets 23 and fix the rear end 230 of the curtain sheet 23 after readjusting the required symmetrical positions of the light-transmitting part 24 and the light-impermeable part 25. Thus, it is cumbersome and time-consuming to adjust the curtain sheet 23. Therefore, the zebra curtain 2 has the above-mentioned disadvantages and needs further improvement.

SUMMARY OF THE INVENTION

The main object of the invention is to solve the problems deriving from a conventional zebra curtain.

In order to achieve the object of the invention, the invention provides a zebra curtain, comprising a curtain rolling device, an upper rail disposed behind the curtain rolling device, two corresponding fixing brackets provided for axially connecting the upper rail with the curtain rolling device, a lower rail and a curtain sheet, wherein two ends of the curtain sheet are respectively fixed on the upper rail and the curtain rolling device to make the curtain sheet be wound around outer surfaces of the curtain rolling device, wherein the zebra curtain is characterized in that: the upper rail comprises a first shaft sleeve located at one end of the upper rail, and a second shaft sleeve located at the other end of the upper rail; the upper rail is provided for inserting a starting end of the curtain sheet to make the curtain sheet be wound around an outer surface of the upper rail; the first shaft sleeve comprises a first inlay inserted into one end of the upper rail, a first covering wall connected to one end of the first inlay and covered at one end of the upper rail, and a first protruding shaft protrudingly formed in an opposite direction from the first inlay and connected to the first covering wall, wherein the first protruding shaft is a square shaft; the second shaft sleeve comprises a bearing, a second protruding shaft, a spring and a positioning piece, wherein the bearing comprises a second inlay inserted into the other end of the upper rail, a second covering wall connected to one end of the second inlay and covered at the other end of the upper rail, a through hole formed at one end of the second inlay facing the upper rail, a chamber located inside the second inlay and communicated with the through hole, and an inlet communicating with the chamber and the through hole; the second protruding shaft comprises a shaft rod and a square shaft connecting with the shaft rod, wherein the shaft rod penetrates into the through hole from the inlet of the second covering wall; the spring is sleeved on an outer surface of the shaft rod and moves back and forth inside the chamber of the second inlay; and the positioning piece is engaged with one end of the shaft rod; the outer surface of the curtain rolling device is provided for placing a terminal of the curtain sheets; the fixing brackets comprise fixing bodies arranged and fixed on two sides of top of a window and stand frames connected below the fixing bodies, each of the stand frames is provided for the first protruding shaft of the first shaft sleeve connected with the square shaft of the second protruding shaft; the lower rail is arranged below the upper rail at an interval; the curtain sheet comprises a plurality of light-transmitting parts with a plurality of holes and a plurality of light-impermeable portions without the plurality of holes; and the plurality of light-transmitting parts and the plurality of light-impermeable portions are arranged at intervals to form a forward overlap double-layered curtain cloth, wherein the second protruding shaft moves back and forth inside the bearing through an action of the spring to press the second protruding shaft and to compress the spring mounted inside the bearing, such that the square shaft of the second protruding shaft is separated from the fixing bracket at the left side to take off the zebra curtain, and then after adjusting the plurality of light-transmitting parts and the plurality of light-impermeable parts of the curtain sheet to be forward overlapped, the first protruding shaft is axially connected with the fixing bracket at the right side; and wherein the second protruding shaft is gradually returns to an original state by the action of the spring being compressed after the second protruding shaft, which is previously pressed, is released, and the second protruding shaft is axially connected with the fixing bracket at the left side.

In one embodiment, a screw hole is formed at one end of the shaft rod facing the through hole and another end is located opposite to the screw hole on the shaft rod; wherein the second protruding shaft further includes an arc-shaped protrusion, one side of the arc-shaped protrusion is connected with one side of the square shaft, and a length of the square shaft is longer than a length of the arc-shaped protrusion, so that one end of the square shaft protrudes one end of the arc-shaped protrusion without connecting to the shaft rod, and the arc-shaped protrusion and the square shaft are align left to connect with the end of the shaft rod; wherein one end of the spring abuts against one end of the shaft rod connected with the square shaft, and the other end of the spring abuts against a bottom end of the chamber of the second inlay; and wherein the positioning piece is a screw member including an outer screw, and the outer screw of the positioning piece is correspondingly screwed with the screw hole of the shaft rod.

In one embodiment, the upper rail is an elongated hollow rail base, and an insertion groove is provided on the upper rail for inserting a starting end of the curtain sheet; wherein a groove channel is formed on an outer surface of the curtain rolling device for placing a terminal of the curtain sheets to be fixed therein, two ends of the curtain rolling device are provided with square fixing columns; wherein the fixing bodies are provided with vertical members which includes a plurality of fixing holes in a transverse portion and a longitudinal portion, two sides of the vertical members below the plurality of fixing holes in the longitudinal portion are bent inwardly, each of the stand frames is provided with a connection portion connecting a bottom end of the longitudinal portion of each vertical member and a guide portion extending from a lower part of the connection portion; and two shaft holes are respectively located at top of each side of the connection portions, and shapes of the two shaft holes are designed as square holes for inserting the first protruding shaft of the first shaft sleeve and the square shaft of the second protruding shaft; wherein two grooves are formed below two shaft holes on the guide portion thereof, so that the curtain rolling device is temporarily placed when being mounted; and wherein the guide portion is provided with a square through hole between the two grooves for the fixing columns to pass through and to be positioned, a guide groove is formed below the square through hole and bent toward an outer side of the guide portion for guiding the fixing columns to be positioned into the through holes.

Compared with the prior art, the invention has the following advantages: the second protruding shaft moves back and forth inside the bearing through an action of the spring to press the second protruding shaft and to compress the spring mounted inside the bearing, such that the one end of the square shaft of the second protruding shaft is separated from the other one of the two shaft holes of the fixing bracket at the left side to take off the zebra curtain, and then after adjusting the plurality of light-transmitting parts and the plurality of light-impermeable parts of the curtain sheet to be forward overlapped, the first protruding shaft is axially connected with the fixing bracket at the right side; and wherein the second protruding shaft is gradually returns to an original state by the action of the spring being compressed after the second protruding shaft, which is previously pressed, is released, and the second protruding shaft is axially connected with the fixing bracket at the left side. Therefore, the arc-shaped protrusion of the second protruding shaft abuts against the an inner sides of the stand frames to prevent the second protruding shaft from coming out falling off from the outer side of the other shaft hole of the fixing bracket at the left end, so that a the user can conveniently adjust the ratio of the symmetrical positions of the plurality of light-transmitting parts and the plurality of light-impermeable parts of the curtain sheets to be forward overlapped as required to meet the light and dark state of indoor space light required by the user.

DETAILED DESCRIPTION OF THE PREFERRED EMBODIMENTS

Figure 1:
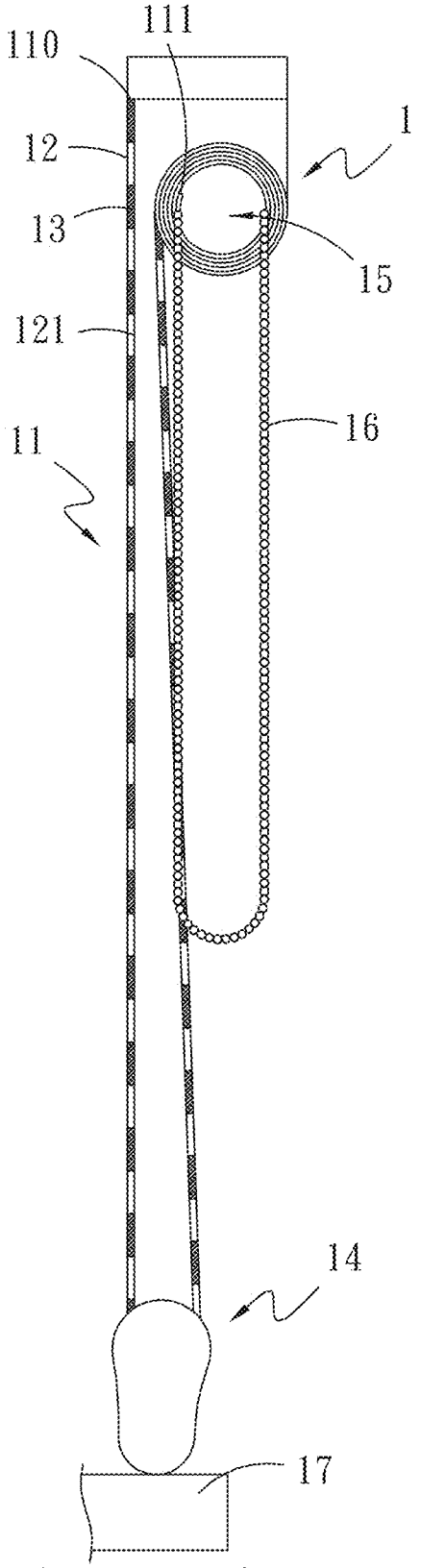
Fig.1 PRIOR ART
FIG. 1 is a side view showing a bottom of curtain sheets of an existing zebra curtain against a window sill.
Figure 2:
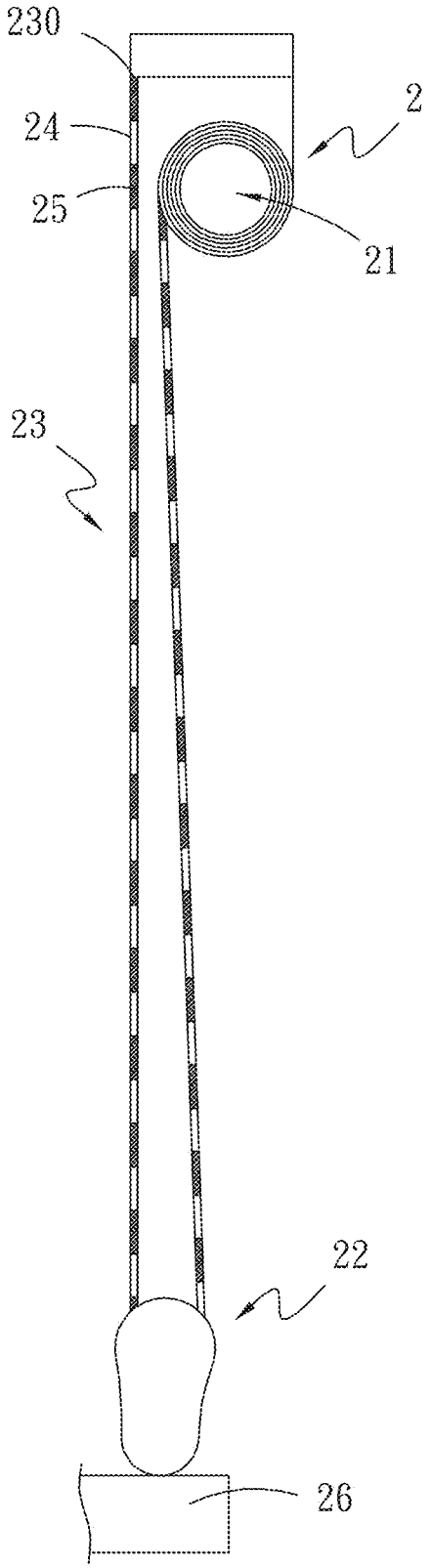
Fig.2 PRIOR ART
FIG. 2 is a side view showing a bottom of curtain sheets of another existing zebra curtain against a window sill.
Figure 3:
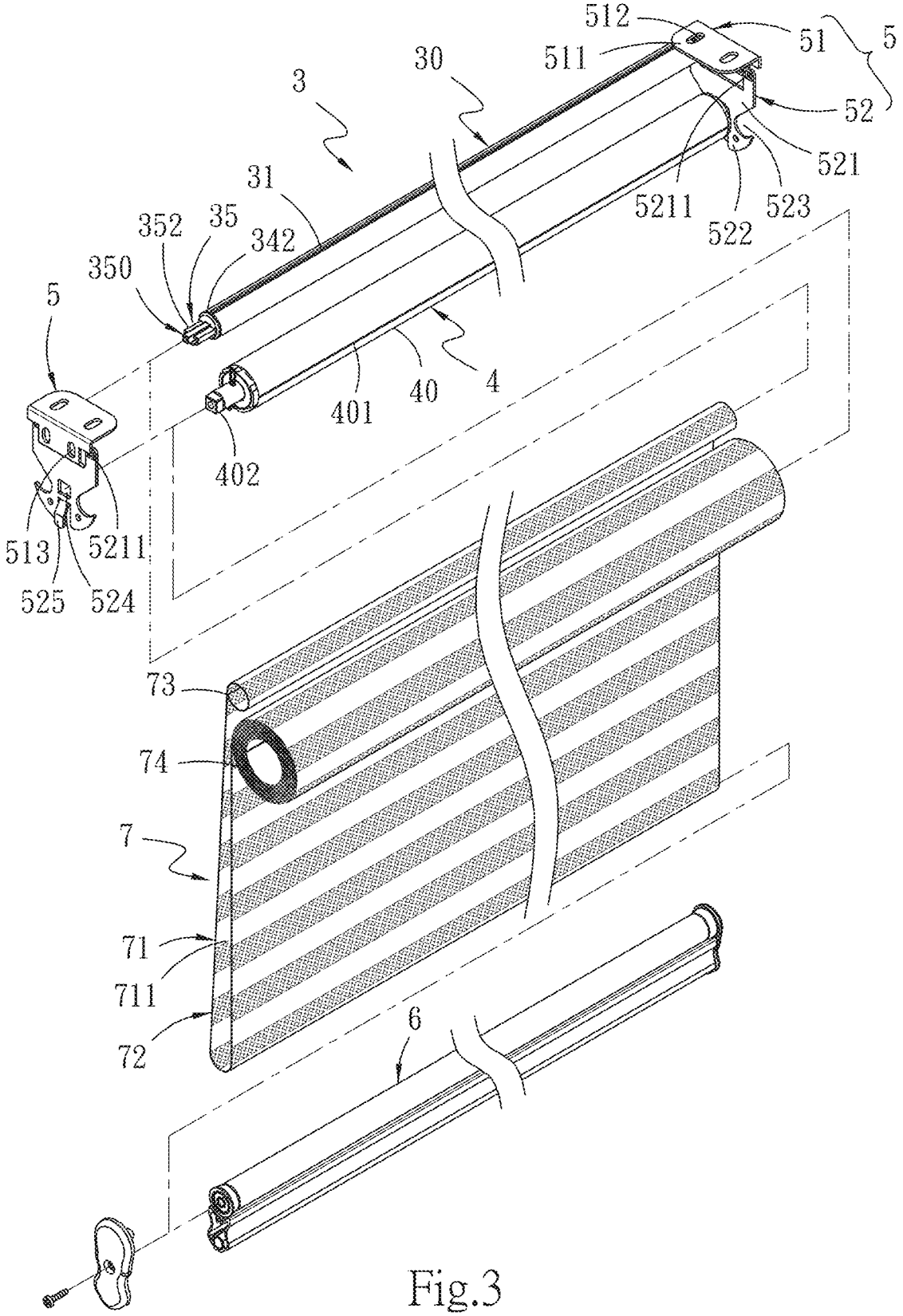
FIG. 3 is an exploded perspective view of the zebra curtain.
Figure 4:
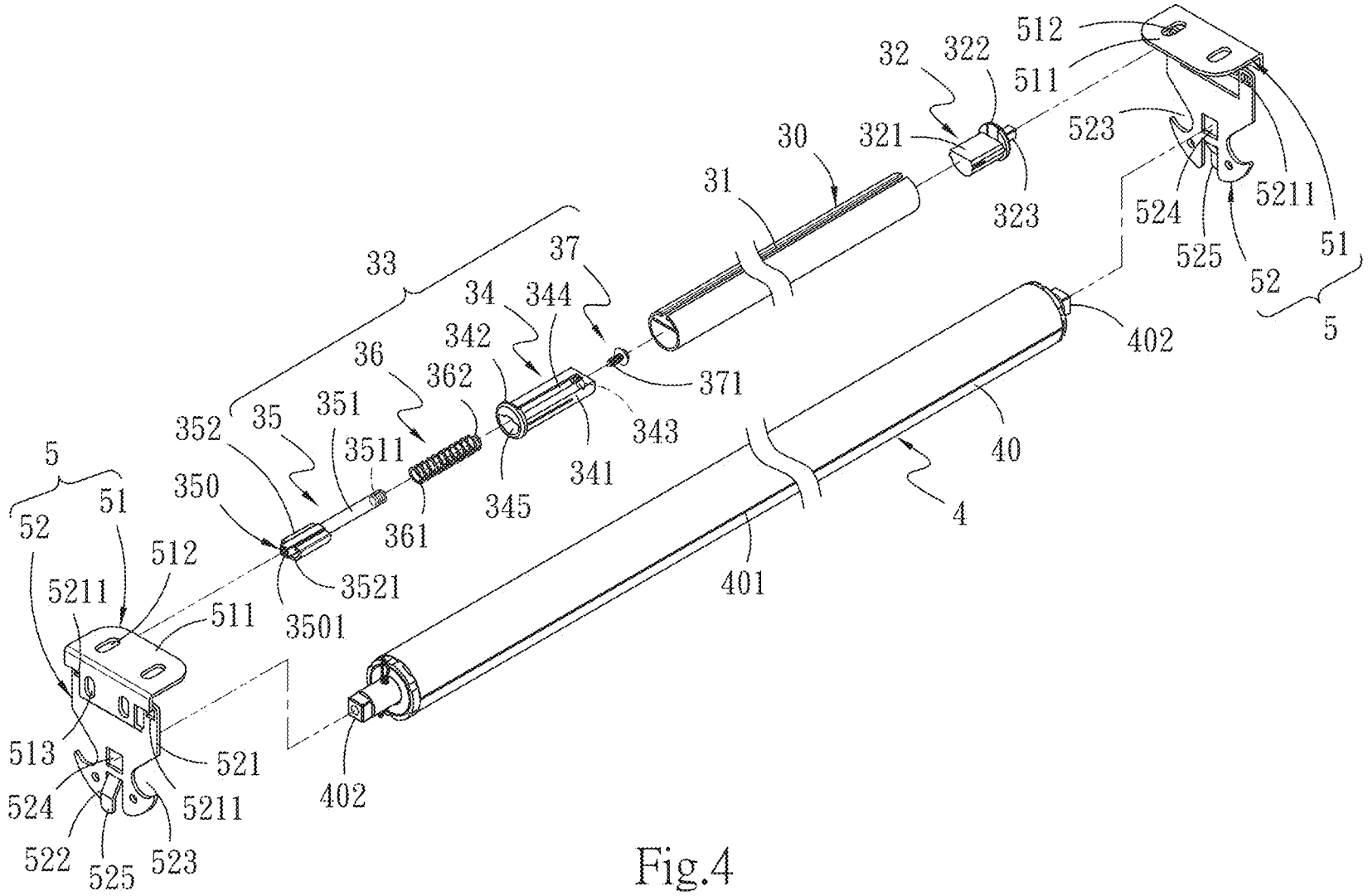
FIG. 4 is an exploded perspective view of an upper rail, a curtain rolling device and fixing brackets on two side of the zebra curtain in FIG. 3.
Figure 5:
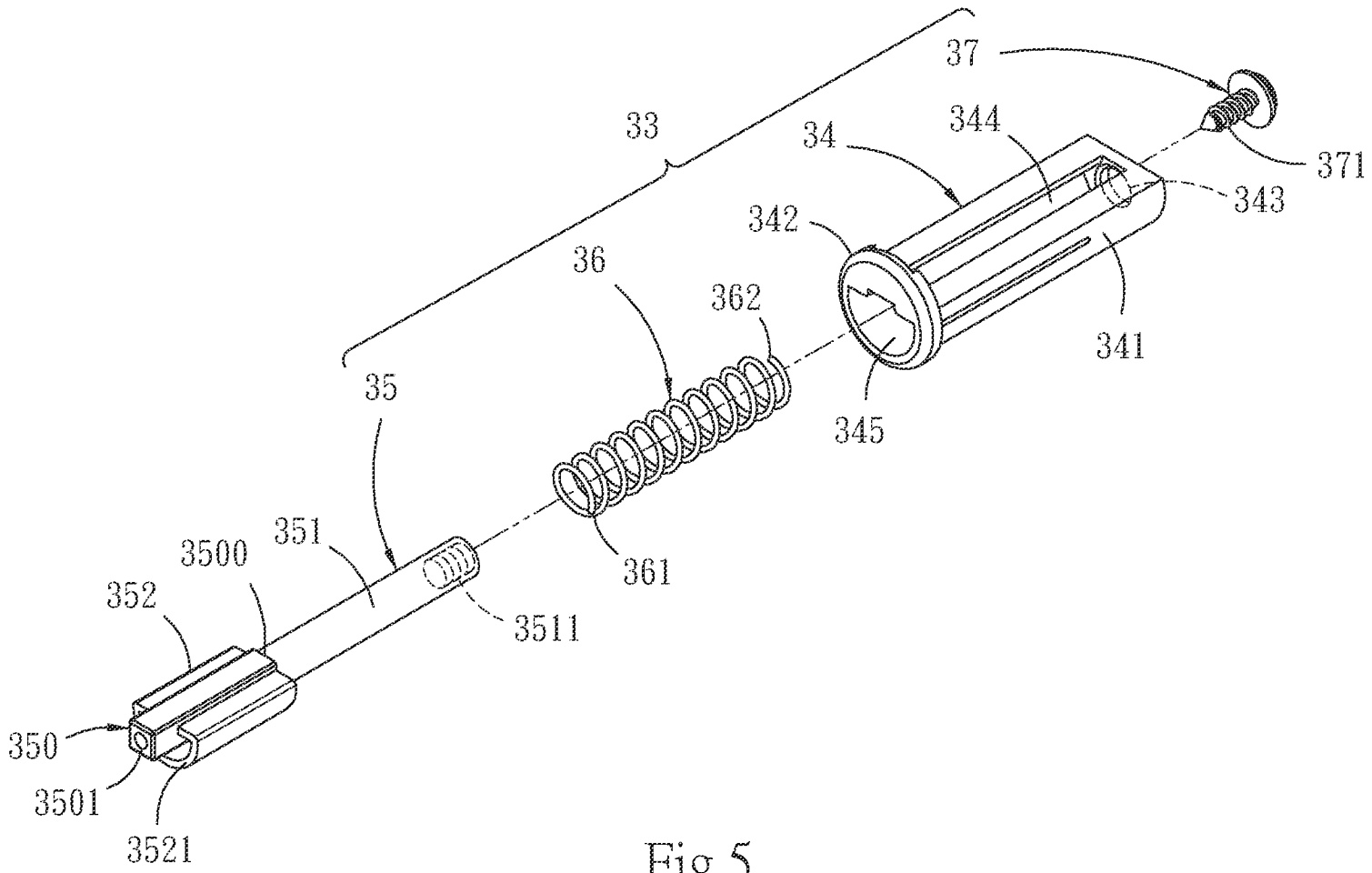
FIG. 5 is an exploded perspective view of the second shaft sleeve of the zebra curtain in FIG. 3.
Figure 6:
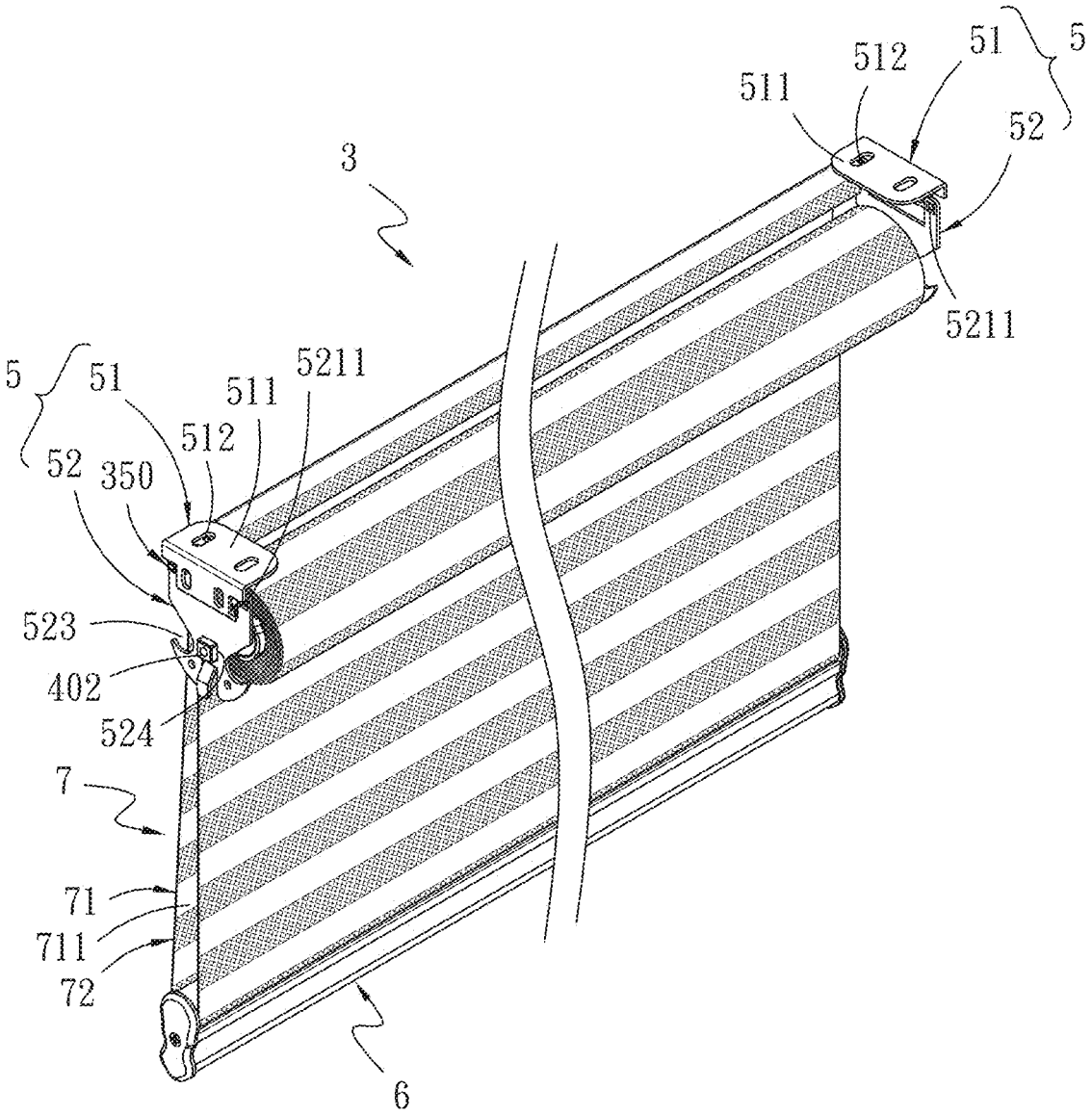
FIG. 6 is a combined perspective view of the zebra curtain in FIG. 3.
Figure 7A:
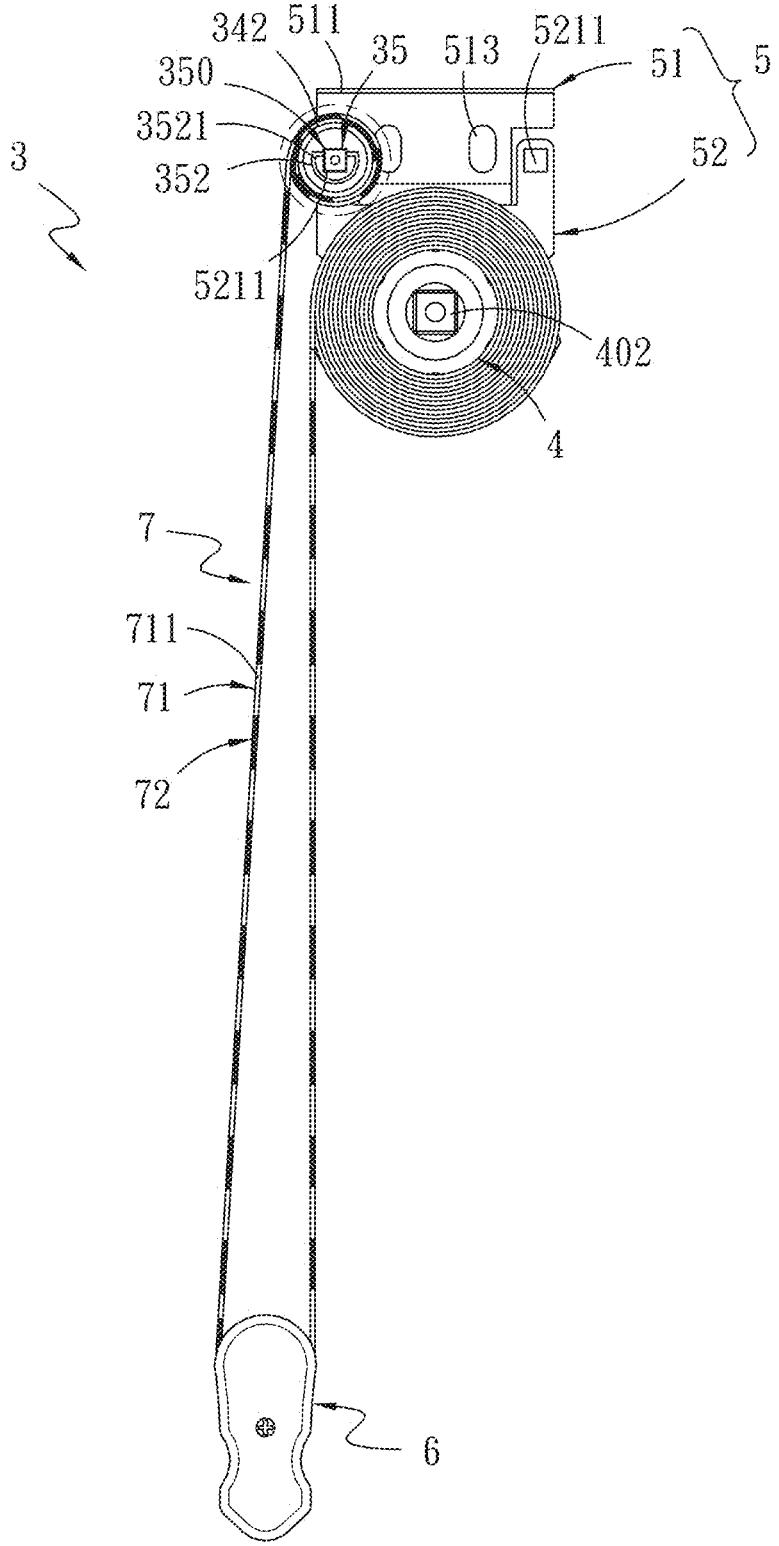
FIG. 7A is a side view of the zebra curtain in FIG. 6.
Figure 7B:
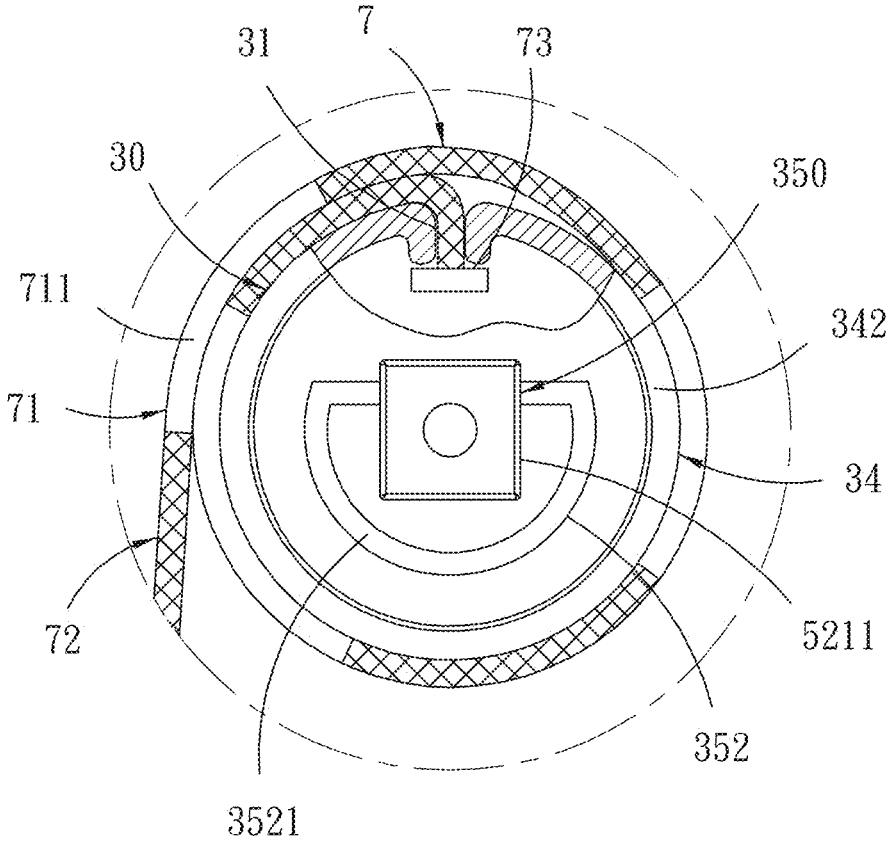
FIG. 7B is an enlarged partial side view of FIG. 7A with one end of the curtain sheets fixed to the upper rail.
Figure 8A:
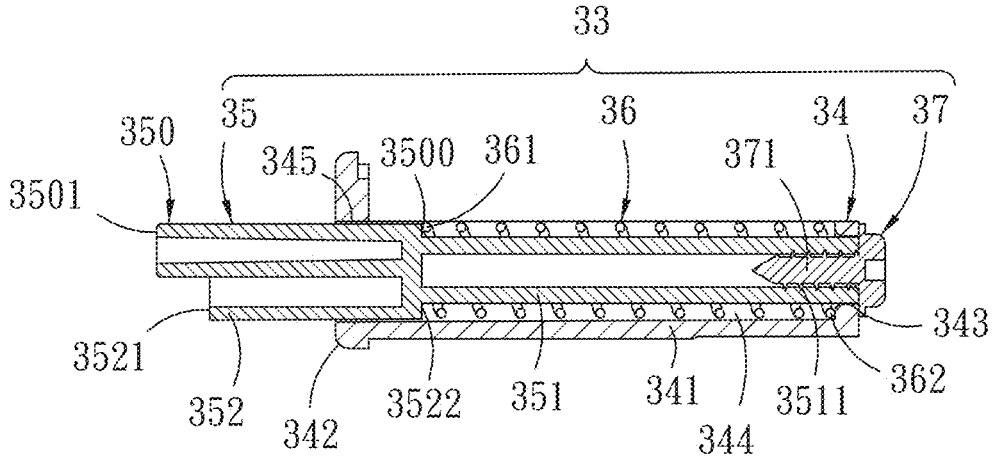
FIG. 8A is a combined sectional view of the second shaft sleeve in FIG. 5.
Figure 8B:
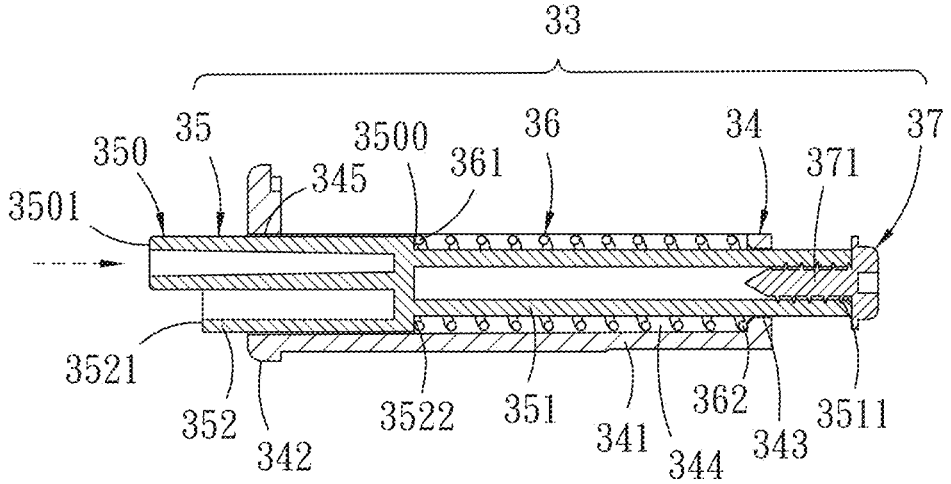
FIG. 8B is a sectional view of FIG. 8A with the second shaft sleeve pressed.

The detailed description and technical contents of the present disclosure will now be described with reference to the drawings as follows.

With reference to FIG. 3, FIG. 4, FIG. 5, FIG. 6, FIG. 7A, FIG. 7B, FIG. 8A and FIG. 8B, the present invention provides a zebra curtain 3 which includes a curtain rolling device 4, an upper rail 30 disposed of behind the curtain rolling device 4, two fixing brackets 5 provided for axially connecting the upper rail 30 with the curtain rolling device 4, a lower rail 6 arranged below the upper rail 30 at an interval, and a curtain sheet 7, wherein two ends of the curtain sheet 7 are respectively fixed on the upper rail 30 and the curtain rolling device 4 so that the curtain sheet 7 can be wound around outer surfaces of the curtain rolling device 4, the lower rail 6 and the upper rail 30.

The upper rail 30 is an elongated hollow rail base. The upper rail 30 includes a first shaft sleeve 32 located at one end of the upper rail 30, and a second shaft sleeve 33 located at the other end of the upper rail 30. An insertion groove 31 is provided on the upper rail 30 for inserting a starting end 73 of the curtain sheet 7 so that the curtain sheet 7 can be wound around an outer surface of the upper rail 30. The first shaft sleeve 32 comprises a first inlay 321 inserted into one end of the upper rail 30, a first covering wall 322 connected to one end of the first inlay 321 and covered at one end of the upper rail 30, and a first protruding shaft 323 protrudingly formed at an opposite direction from the first inlay 321 and connected to the first covering wall 322. In this embodiment, the first protruding shaft 323 is a square shaft. The second shaft sleeve 33 comprises a bearing 34, a second protruding shaft 35, a spring 36 and a positioning piece 37. The bearing 34 includes a second inlay 341 inserted into the other end of the upper rail 30, a second covering wall 342 connected to one end of the second inlay 341 and covered at the other end of the upper rail 30, a through hole 343 formed at one end of the second inlay 341 facing the upper rail 30, a chamber 344 located inside the second inlay 341 and communicated with the through hole 343, and an inlet 345 communicating with the chamber 344 and the through hole 343. The second protruding shaft 35 includes a shaft rod 351 and a square shaft 350 connecting with the shaft rod 351, wherein the shaft rod 351 penetrates into the through hole 343 from the inlet 345 of the second covering wall 342. A screw hole 3511 is formed at one end of the shaft rod 351 facing the through hole 343 and an end 3500 is located opposite to the screw hole 3511 on the shaft rod 351. The second protruding shaft 35 further includes an arc-shaped protrusion 352, one side of the arc-shaped protrusion 352 is connected with one side of the square shaft 350, and a length of the square shaft 350 is longer than a length of the arc-shaped protrusion 352, so that one end 3501 of the square shaft 350 protrudes one end 3521 of the arc-shaped protrusion 352 without connecting to the shaft rod 351, and the arc-shaped protrusion 352 and the square shaft 350 are align left to connect with one end 3500 of the shaft rod 351. The spring 36 is sleeved on an outer surface of the shaft rod 351, one end 361 of the spring 36 abuts against one end 3500 of the shaft rod 351 connected with the square shaft 350, and the other end 362 of the spring 36 abuts against a bottom end of the chamber 344 of the second inlay 341, so that the second protruding shaft 35 moves back and forth inside the chamber 344 of the second inlay 341 through an action of the spring 36. The positioning piece 37 is a screw member including an outer screw 371, and the outer screw 371 of the positioning piece 37 is correspondingly screwed with the screw hole 3511 of the shaft rod 351.

The curtain rolling device 4 is provided with a hollow sleeve 40, a groove channel 401 is formed on an outer surface of the hollow sleeve 40 for placing a terminal 74 of the curtain sheets 7 to be fixed therein, two ends of the curtain rolling device 4 are provided with square fixing columns 402, the curtain rolling device 4 is a conventional structure and will not be described in detail here.

With reference to FIG. 3, FIG. 4, FIG. 5, FIG. 6 and FIG. 7A, the fixing brackets 5 are arranged and fixed on two sides of top of a window. The fixing brackets 5 comprise fixing bodies 51 and stand frames 52 connected below the fixing bodies 51. The fixing bodies 51 are provided with vertical members 511 which includes a plurality of fixing holes 512 (513) in a transverse portion and a longitudinal portion. Two sides of the vertical members 511 below the plurality of fixing holes 513 in the longitudinal portion are bent inwardly. Each of the stand frames 52 is provided with a connection portion 521 connecting a bottom end of the longitudinal portion of each vertical member 511, and a guide portion 522 extending from a lower part of the connection portion 521. Two shaft holes 5211 are respectively located at top of each side of the connection portions 521. Shapes of the two shaft holes 5211 are designed as square holes for inserting the first protruding shaft 323 of the first shaft sleeve 32 and the end 3501 of the second protruding shaft 35, the first covering wall 322 of the first shaft sleeve 32 and the arc-shaped protrusion 352 of the second protruding shaft 35 respectively abut against inner sides of each of the stand frames 52. Two grooves 523 are formed below two shaft holes 5211 on the guide portion 522 thereof, so that the curtain rolling device 4 can be temporarily placed when being mounted. The guide portion 522 is provided with a square through hole 524 between the two grooves 523 for the fixing columns 402 to pass through and to be positioned. A guide groove 525 is formed below the square through hole 524 and bent toward an outer side of the guide portion 522 for guiding the fixing columns 402 to be positioned into the through holes 524.

The starting end 73 of the curtain sheet 7 is embedded in the insertion groove 31 of the upper rail 30, the terminal end 74 of the curtain sheet 7 is embedded in the groove channel 401 of the curtain rolling device 4. In one embodiment, the curtain sheet 7 includes a plurality of light-transmitting parts 71 with a plurality of holes 711 and a plurality of light-impermeable portions 72 without the plurality of holes, and the plurality of light-transmitting parts 71 and the plurality of light-impermeable portions 72 are arranged at intervals to form a forward overlap double-layered curtain cloth.

Figure 9A:
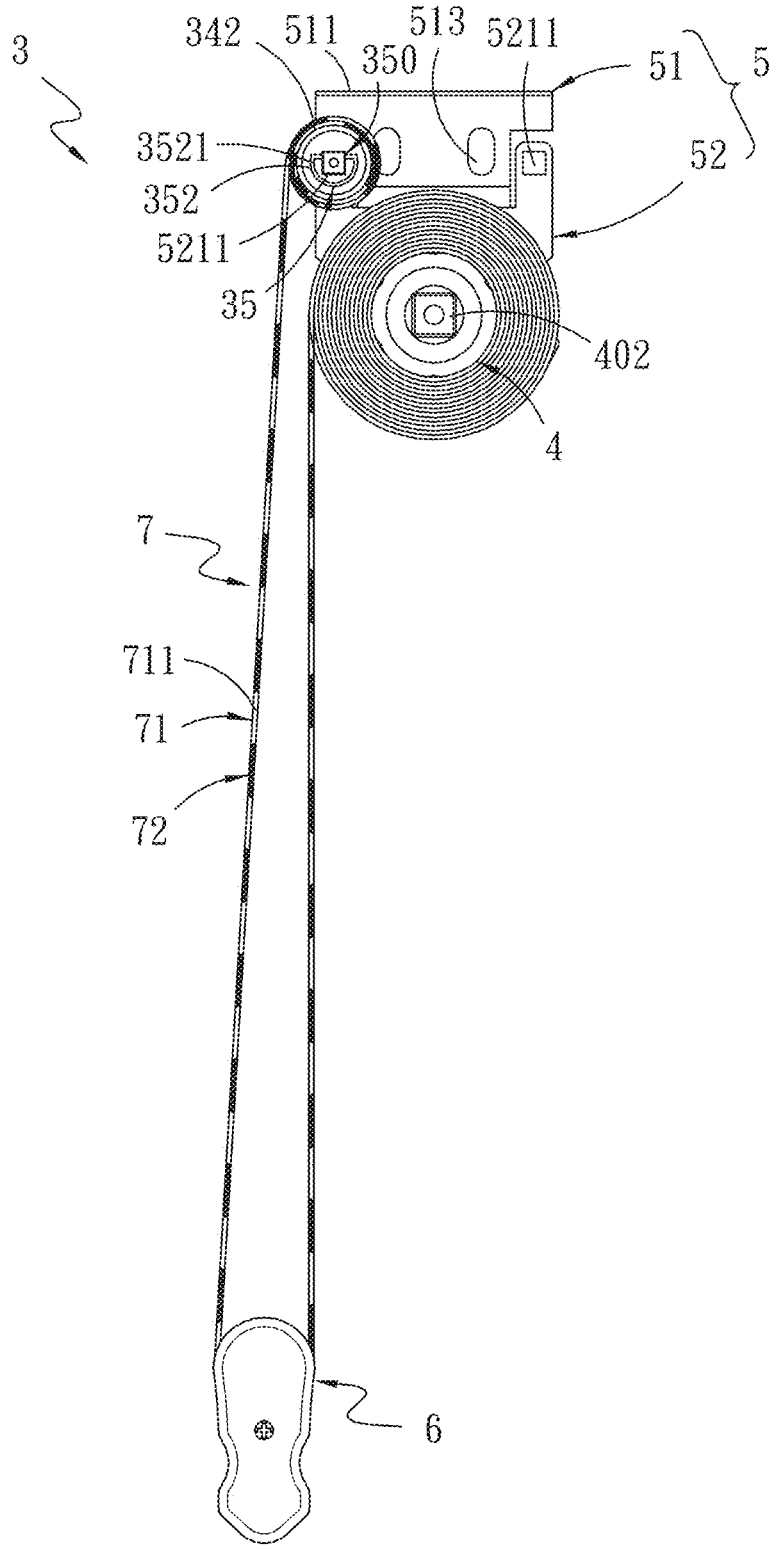
FIG. 9A is a side view of the zebra curtain with the light-transmitting parts and the light-impermeable parts of the curtain sheets not aligned.
Figure 9B:
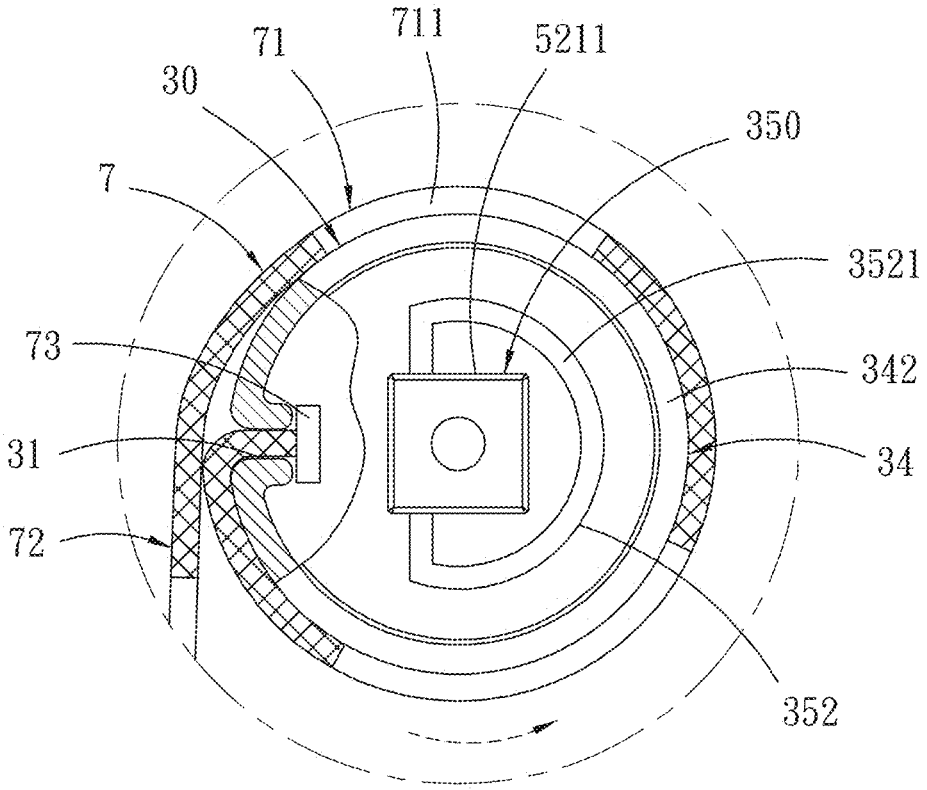
FIG. 9B is an enlarged schematic side view of FIG. 9A adjusting the fixed position of one end of the curtain sheets with the upper rail in a counterclockwise direction.
Figure 9C:
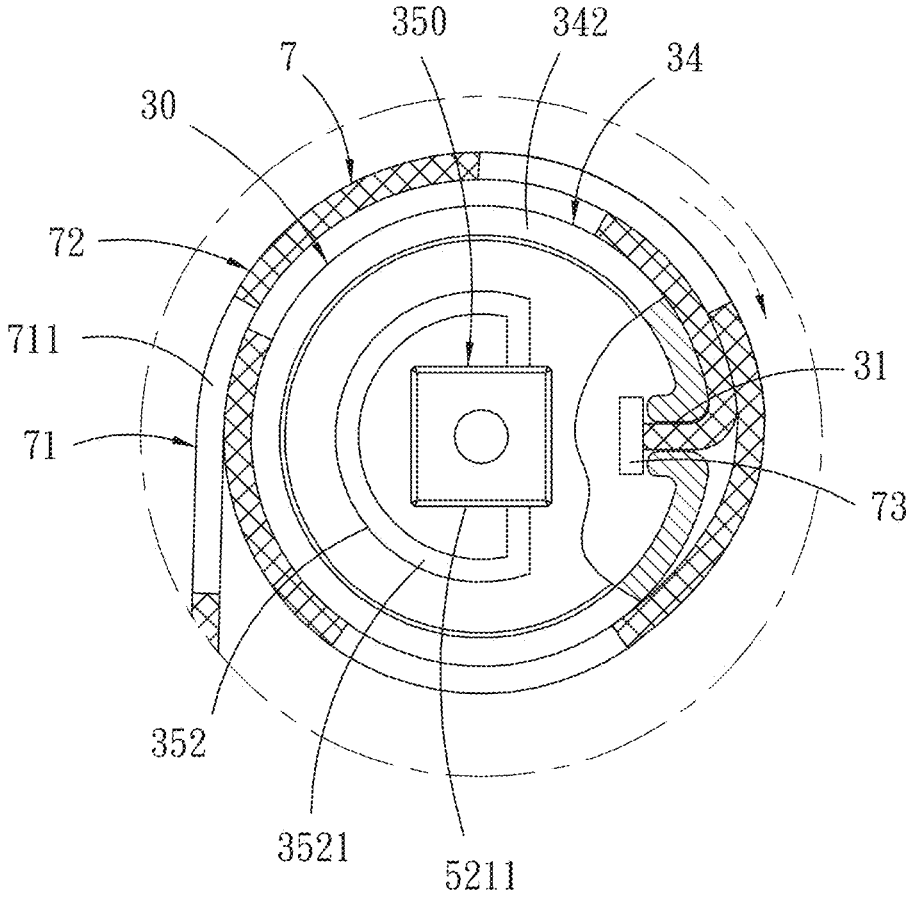
FIG. 9C is an enlarged schematic side view of FIG. 9A adjusting the fixed position of one end of the curtain sheets with the upper rail in a clockwise direction.
Figure 9D:
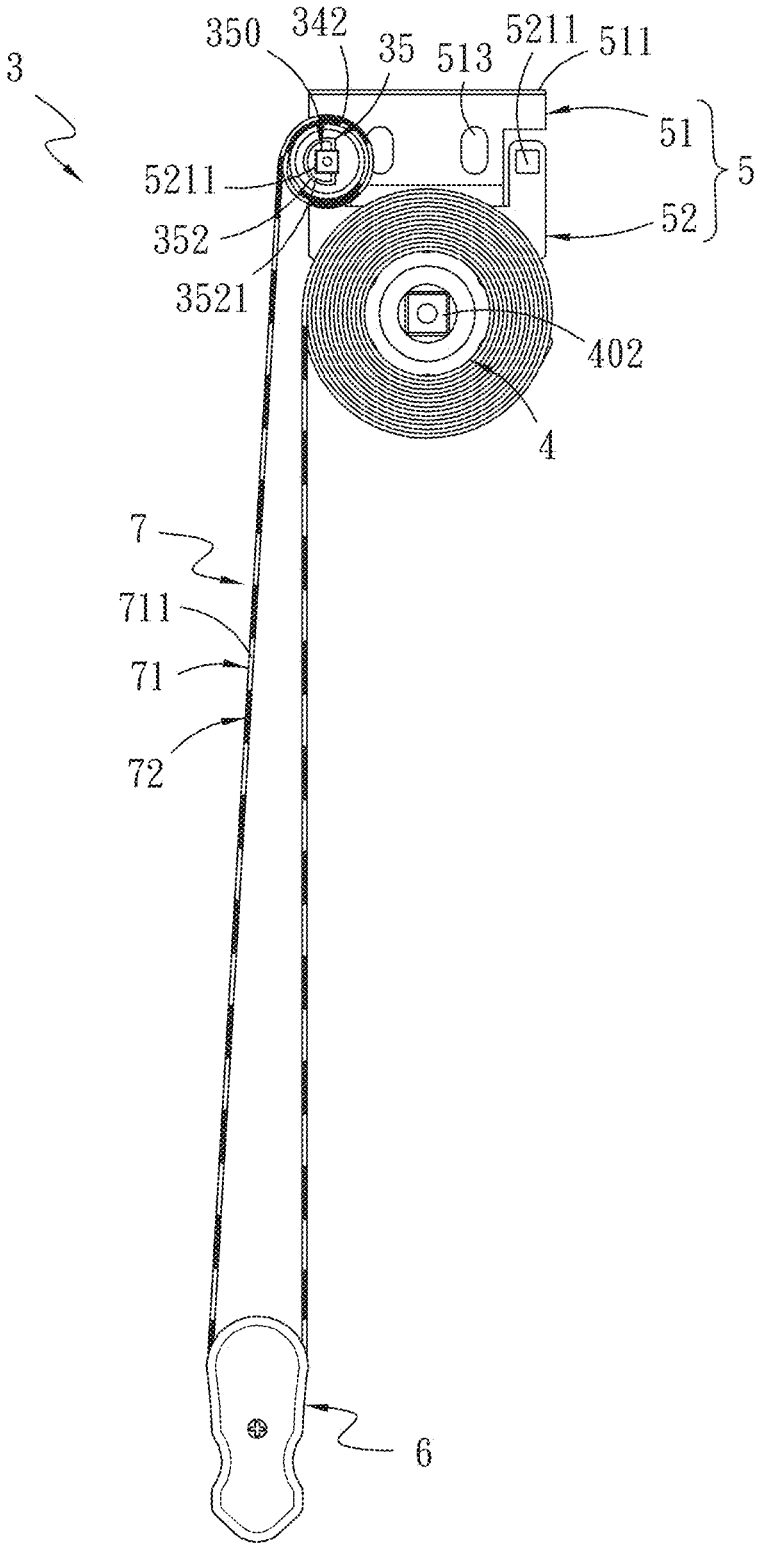
FIG. 9D is a side view of the zebra curtain in FIG. 9C with symmetrical positions, overlapping the light-transmitting parts and the light-impermeable parts of the curtain sheets, of front part and rear part of the zebra curtain aligned.

With reference to FIG. 3 FIG. 4, FIG. 5, FIG. 6, FIG. 7A, FIG. 7B, FIG. 8A, FIG. 8B, FIG. 9A, FIG. 9A, FIG. 9B, FIG. 9C and FIG. 9D, the fixing brackets 5 are fixed at the two sides of top of the window in order to mount the zebra curtain 3, the starting end 73 of the curtain sheet 7 is embedded into the insertion groove 31 of the upper rail 30, and the terminal end 74 of the curtain sheet 7 is inserted into the groove channel 401 of the curtain rolling device 4 to be positioned. The terminal end 74 of the curtain sheet 7 is wound around an outer surface of the curtain rolling device 4, so that the first protruding shaft 323 of the first shaft sleeve 32 arranged at one end of the upper rail 30 is axially connected with one of the two shaft holes 5211 of the fixing bracket 5 at the right side, and the spring 36 arranged inside the bearing 34 is regulated through the second protruding shaft 35 so as to assemble the second shaft sleeve 33. The square shaft 350 of the second protruding shaft 35 is axially connected with the other one of the two shaft holes 5211 of the fixing bracket 5 at the left side. When the zebra curtain 3 is assembled, if the bottom end of the curtain sheet 7 collides against a window sill, and the plurality of light-transmitting parts 71 and the plurality of light-impermeable parts 72 of the curtain sheet 7 are not forward overlapped. Thus, a user can press the second protruding shaft 35 to compress the spring 36 mounted inside the chamber 344, so that the one end 3501 of the square shaft 350 of the second protruding shaft 35 is separated from the other one of the two shaft holes 5211 of the fixing bracket 5 at the left side to take off the zebra curtain 3, and then the upper rail 30 is rotated in a clockwise or a counterclockwise direction as required to wind around the curtain sheet 7 on the outer surface of the upper rail 30, such as shown in FIGS. 9B and 9C. After adjusting the plurality of light-transmitting parts 71 and the plurality of light-impermeable parts 72 of the curtain sheet 7 to be forward overlapped, the first protruding shaft 323 at one end of the upper rail 30 is axially connected with one of the two shaft holes 5211 of the fixing bracket 5 at the right side, the second protruding shaft 35 is pressed through the spring 36 inside the bearing 34 to be for telescopic deformation. After the second protruding shaft 35, which is previously pressed, is released, the second protruding shaft 35 gradually returns to an original state by the action of the spring 36 being compressed, and one end 3501 of the square shaft 350 of the second protruding shaft 35 is axially connected with the other one of the two shaft holes 5211 of the fixing bracket 5 at the left side, so that the arc-shaped protrusion 352 of the second protruding shaft 35 abuts against an inner side of the stand frames 52 to prevent the second protruding shaft 35 from falling off, so that the user can conveniently adjust the plurality of light-transmitting parts 71 and the plurality of light-impermeable parts 72 of the curtain sheet 7 to be forward overlapped as required to meet the light and dark state of indoor space light required by the user.

What is claimed is:

1. A zebra curtain, comprising a curtain rolling device, an upper rail disposed behind the curtain rolling device, two fixing brackets respectively arranged on a left side and a right side of a top of a window for axially connecting the upper rail and the curtain rolling device, a lower rail and a curtain sheet, wherein a starting end of the curtain sheet is fixed on the upper rail and a terminal end of the curtain sheet is fixed on the curtain rolling device to make the curtain sheet be wound around outer surfaces of the curtain rolling device, the lower rail and the upper rail, wherein the zebra curtain is characterized in that: the upper rail is provided for inserting the starting end of the curtain sheet to make the curtain sheet be wound around the outer surface of the upper rail, and the upper rail comprises:

a first shaft sleeve, located at a first end of the upper rail, the first shaft sleeve comprising a first inlay inserted into the first end of the upper rail, a first covering wall connected to one end of the first inlay and covering the first end of the upper rail, and a first protruding shaft protrudingly formed at the first covering wall and extending in an opposite direction from the first inlay, wherein the first protruding shaft is a square shaft; and a second shaft sleeve located at a second end of the upper rail, the second shaft sleeve comprising a bearing, a second protruding shaft, a spring and a positioning piece, wherein the bearing comprises a second inlay inserted into the second end of the upper rail, a second covering wall connected to a first end of the second inlay and covering the second end of the upper rail, a through hole formed at a second end of the second inlay, a chamber located inside the second inlay and communicating with the through hole, and an inlet formed at the second covering wall and communicating with the chamber and the through hole;

the second protruding shaft comprises a shaft rod and a square shaft connecting with the shaft rod, wherein the shaft rod penetrates into the through hole from the inlet of the second covering wall, and the second protruding shaft is configured to move back and forth inside the bearing via an action of the spring;

the spring is sleeved on an outer surface of the shaft rod and configured to be compressed or expand inside the chamber of the second inlay; and the positioning piece is engaged with a first end of the shaft rod;

each of the two fixing brackets comprises a fixing body and a stand frame connected below the fixing body, the two stand frames on the left side and the right side are provided for connecting the first protruding shaft of the first shaft sleeve and the square shaft of the second protruding shaft, respectively;

the lower rail is arranged below the upper rail at an interval; and the curtain sheet comprises a plurality of light-transmitting parts with a plurality of holes and a plurality of light-impermeable portions without the plurality of holes; and the plurality of light-transmitting parts and the plurality of light-impermeable portions are arranged at intervals to form a forward overlap double-layered curtain cloth, wherein the upper rail is configured to be disconnected from the fixing bracket at the left side by pressing the second protruding shaft to compress the spring mounted inside the bearing to disassemble the upper rail, to wind the curtain sheet to adjust a position of the plurality of light-transmitting parts and the plurality of light-impermeable parts, to axially connect the first protruding shaft with the fixing bracket at the right side, and to connect the second protruding shaft with the fixing bracket at the left side by pressing the second protruding shaft and the action of the spring to assemble the upper rail, the upper rail is rotationally fixed when connected to the two fixing brackets.

2. The zebra curtain according to claim 1, wherein a screw hole is formed at the first end of the shaft rod near the through hole, wherein the second protruding shaft further includes an arc-shaped protrusion, two sides of the arc-shaped protrusion are connected with two sides of the square shaft, and a length of the square shaft is longer than a length of the arc-shaped protrusion, so that a first end of the square shaft without connecting with the shaft rod protrudes from the arc-shaped protrusion, and a second end of the square shaft connecting with the shaft rod is aligned with the arc-shaped protrusion; wherein a first end of the spring abuts against the second end of the square shaft connecting with the shaft rod, and a second end of the spring abuts against a bottom end of the chamber of the second inlay; and wherein the positioning piece is a screw member including an outer screw, and the outer screw of the positioning piece is correspondingly screwed with the screw hole of the shaft rod.

3. The zebra curtain according to claim 1, wherein the upper rail is an elongated hollow rail base, and an insertion groove is provided on the upper rail for inserting the starting end of the curtain sheet; wherein a groove channel is formed on the outer surface of the curtain rolling device for placing the terminal end of the curtain sheets to be fixed therein, two ends of the curtain rolling device are provided with fixing columns which are square; wherein the fixing bodies are provided with vertical members, each of the vertical members is provided with a transverse portion and a longitudinal portion bent inwardly, and the vertical members include a plurality of fixing holes in the transverse portion and the longitudinal portion, each of the stand frames is provided with a connection portion connecting a bottom end of the longitudinal portion of each vertical member and a guide portion extending from a lower part of the connection portion; and two shaft holes are respectively located at a top of two sides of the connection portions, and the two shaft holes are square holes for inserting the first protruding shaft of the first shaft sleeve and the square shaft of the second protruding shaft; wherein two grooves are formed below the two shaft holes on the guide portion for temporarily placing the curtain rolling device when being mounted; and wherein the guide portion is provided with a square through hole between the two grooves for the fixing columns to pass through and to be positioned, and a guide groove is formed below the square through hole and bent toward an outer side of the guide portion for guiding the fixing columns to be positioned into the through holes.

* * * * *